US008911269B2

(12) United States Patent
Takayama

(10) Patent No.: US 8,911,269 B2
(45) Date of Patent: Dec. 16, 2014

(54) CONDUCTOR CONNECTING STRUCTURE

(71) Applicant: Yazaki Corporation, Tokyo (JP)

(72) Inventor: Tsutomu Takayama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/953,940

(22) Filed: Jul. 30, 2013

(65) Prior Publication Data

US 2014/0057502 A1 Feb. 27, 2014

(30) Foreign Application Priority Data

Aug. 27, 2012 (JP) ..... 2012-186058

(51) Int. Cl.

| | |
|---|---|
| ***H01R 4/10*** | (2006.01) |
| ***H01R 4/18*** | (2006.01) |
| ***H01R 11/28*** | (2006.01) |
| ***H01R 4/16*** | (2006.01) |
| ***H01R 4/20*** | (2006.01) |

(52) U.S. Cl.

CPC . *H01R 4/16* (2013.01); *H01R 4/203* (2013.01)
USPC ..... 439/877; 439/422; 439/878; 439/421; 439/880; 439/879

(58) Field of Classification Search

USPC ..... 439/877, 422, 878, 421, 880, 879
See application file for complete search history.

(56) References Cited

U.S. PATENT DOCUMENTS 4,082,402 A 4/1978 Kinkaid et al.
6,375,492 B1 * 4/2002 Hio ..... 439/422

FOREIGN PATENT DOCUMENTS

JP 50-100585 A 8/1975

* cited by examiner

*Primary Examiner* — Jae Lee
*Assistant Examiner* — Justin Kratt
(74) *Attorney, Agent, or Firm* — Sughrue Mion, PLLC

(57) ABSTRACT

A conductor connecting structure comprises a flat circuit body having an insulator and a conductor, and a conductive terminal metal fitting having a conductor connecting part including a first conductor holding part and a second conductor holding part. The first conductor holding part has a first plate-like part formed into a plate-like shape, and a projecting part which projects from a surface of the first plate-like part that is faced to the conductor. The second conductor holding part has a second plate-like part formed into a plate-like shape, and a through hole arranged so as to correspond to a position of the projecting part and penetrating the second plate-like part. When the conductor is sandwiched by the first conductor holding part and the second conductor holding part, the conductor is deformed so as to be pushed into the through hole.

4 Claims, 10 Drawing Sheets

CONDUCTOR CONNECTING STRUCTURE

BACKGROUND OF THE INVENTION

1. Field of the Invention

The present invention relates to a conductor connecting structure for electrically connecting a flat circuit body and a terminal metal fitting.

2. Description of the Related Art

A technique concerning a conductor connecting structure for electrically connecting a flat circuit body and a terminal metal fitting is disclosed, for example, in Japan Patent Publication No. S54-100585.

The flat circuit body may be an FPC (Flexible Printed Circuit) or an FFC (Flexible Fiat Cable), and is used, for example, for the internal wiring of various electronic devices. In recent years, the flat circuit body is used for the wiring of a mobile body such as an automobile.

In conventional art disclosed in Japan Patent Publication No. S54-100585, a plurality of sharp teethes are formed at the distal end of a conductor connecting part of a terminal metal fitting. The sharp teethes at the distal end first stick an insulator part in the flat circuit body, and then the sharp teeth are bent back inward to stick the flat circuit body again. Finally, the distal ends of the sharp teethes contact with the conductor. Because of such a conductor connecting structure, there are several problems concerning connection reliability.

That is, because the conductor of the flat circuit body is damaged by the sharp teeth at the distal end, there is a problem that connection strength decreases. Because when the teeth stab the conductor, contact pressure force decreases and contact resistance increases, there is a problem that it is necessary to precisely control the crimping height to prevent these situations.

Furthermore, because when a position deviation of the flat circuit body occurs, contact pressure force with the conductor decreases, and contact resistance increases, there is possibility in that it is necessary to precisely position the flat circuit body to prevent these situations. Furthermore, because of the conductor connecting structure in which the distal ends of the teeth contact with the conductor, there is a problem that the contact area is small, and accordingly the contact resistance is easy to increase.

For the conventional art, in addition, there is possibility in that a special pressing metal mold or pressing device corresponding to the plurality of sharp teeth at the distal end is necessary.

SUMMARY OF THE INVENTION

The present invention is made in view of the above described circumstances, and the object of the present invention is to provide a conductor connecting structure so that connection reliability can be improved.

A first aspect of the present invention provides with a conductor connecting structure, comprising a flat circuit body having an insulator and a conductor that is exposed from the insulator; and a conductive terminal metal fitting having a conductor connecting part to be electrically connected with the conductor; wherein the conductor connecting part comprises a first conductor holding part and a second conductor holding part; the first conductor holding part has a first plate-like part which is formed into a plate-like shape, and a projecting part which projects from a surface of the first plate-like part that is faced to the conductor; the second conductor holding part has a second plate-like part which is formed into a plate-like shape, and a through hole which is arranged so as to correspond to a position of the projecting part and which penetrates the second plate-like part; and when the conductor is sandwiched by the first conductor holding part and the second conductor holding part, the conductor is deformed by the projecting part so as to be pushed into the through hole and is pressed at a periphery of the through hole.

A second aspect of the present invention provides with the conductor connecting structure according to the first aspect of the present invention, wherein one side parts of the first conductor holding part and the second conductor holding part along a longitudinal direction of the conductor connecting part are formed as a coupling part and a bending part.

A third aspect of the present invention provides with the conductor connecting structure according to the first aspect of the present invention, wherein a plurality of the projecting parts and a plurality of the through holes are formed along the longitudinal direction of the conductor connecting part.

A fourth aspect of the present invention provides with the conductor connecting structure according to the first aspect of the present invention, wherein the projecting part and the through hole are formed so as to be extended along the longitudinal direction of the conductor connecting part.

According to the present invention, the conductor which is exposed is electrically connected by being sandwiched between the first conductor holding part and the second conductor holding part of the terminal metal fitting. The conductor is electrically connected not only by being sandwiched, but also by being deformed and pressed. As can be seen from the conductor connecting structure, the present invention is not the structure in which a part of the terminal metal fitting is stuck into the flat circuit body.

Because the present invention described in the first aspect of the present invention is such a conductor connecting structure that the conductor, which is exposed, of the flat circuit body is sandwiched between the first conductor holding part and the second conductor holding part of the terminal metal fitting, an effect is achieved that when the conductor is electrically connected, damage to the conductor is not caused as conventionally, and as a result, connection strength can be secured.

Because the present invention is such a conductor connecting structure that the conductor is electrically connected by being sandwiched, an effect is achieved that drop of the contact pressure force and increase of the contact resistance is not caused as conventionally, and as a result, for example, dimension management related to the connection can be facilitated.

According to the present invention, because the part that is electrically connected can be easily recognized while the conductor is exposed, an effect is achieved that it is unlikely that a conductor position deviation occurs.

Because the present invention is such a conductor connecting structure that the conductor is electrically connected by being sandwiched, an to effect is achieved that the contact area can be increased remarkably compared with before, and as a result, it is unlikely that increase of the contact resistance is caused.

According to the present invention described in the first aspect of the present invention, an effect is achieved that connection reliability is improved compared with before.

According to the present invention described in the second aspect of the present invention, the following effects are achieved in addition to the effects of the first aspect of the present invention. That is, because the present invention is such a structure that only the coupling part of the consecutive first conductor holding part and second conductor holding part is bent, an effect is achieved that the conductor can be easily electrically connected. The present invention achieves an effect that even if a special pressing metal mold or pressing device is not used as conventionally, the flat circuit body and the terminal metal fitting can be electrically connected.

According to the present invention described in the third aspect of the present invention, the following effects are achieved in addition to the effects of the first aspect. That is, because the plurality of projecting parts and through holes are formed along the longitudinal direction of the conductor connecting part, an effect is achieved that the contact area can be increased.

According to the present invention described in the fourth aspect of the present invention, the following effects are achieved in addition to the effects of the first aspect. That is, because the projecting part and the through hole are formed into a shape that extends along the longitudinal direction of the conductor connecting part, an effect is achieved that the contact area can be increased.

DESCRIPTION OF THE PREFERRED EMBODIMENTS

A structure, in which a conductor of a flat circuit body is connected to a conductor connecting part of a terminal metal fitting to electrically connect the conductor and the conductor connecting part, can be achieved by a structure in which the conductor is sandwiched between a first conductor holding part and a second conductor holding part of the conductor connecting part.

Embodiment 1

Figure 1:
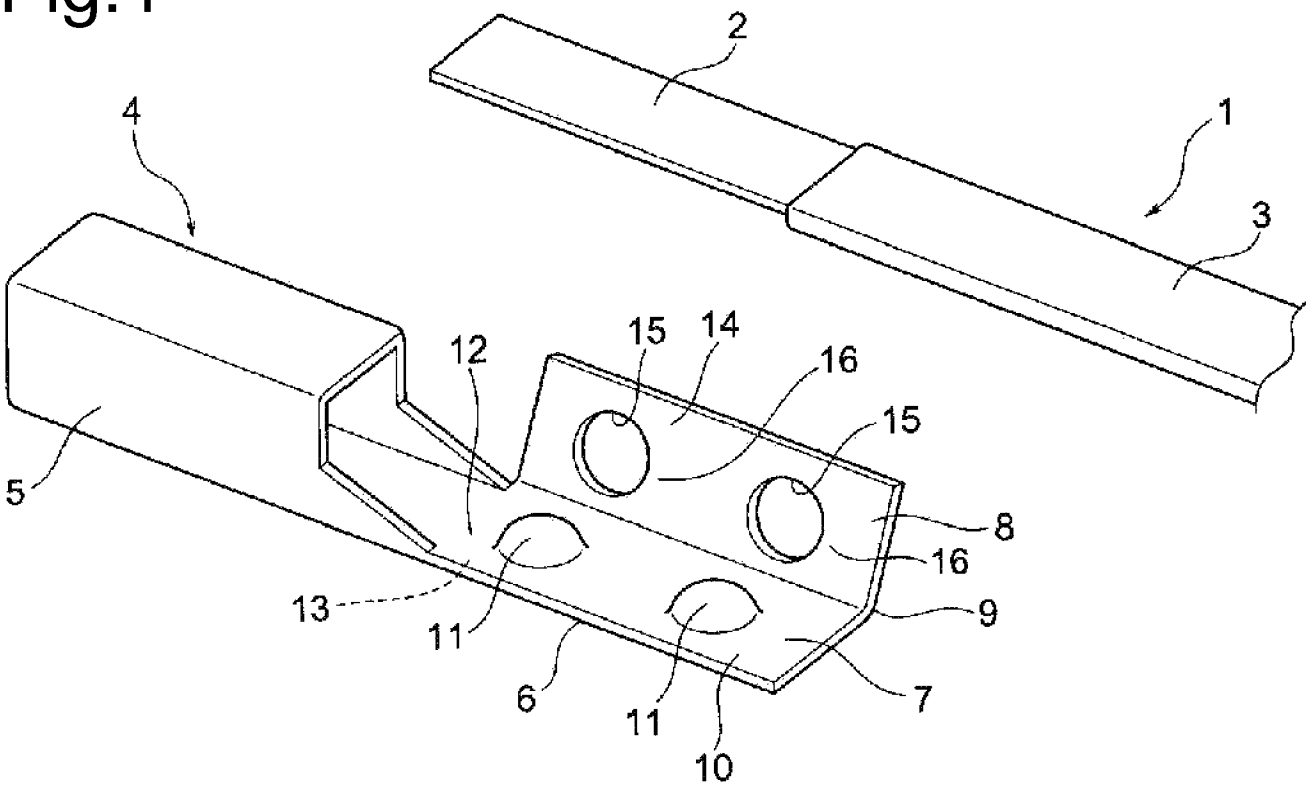
FIG. 1 is a perspective view of a flat circuit body and a terminal metal fitting of a conductor connecting structure of the present invention (embodiment 1).
Figure 2:
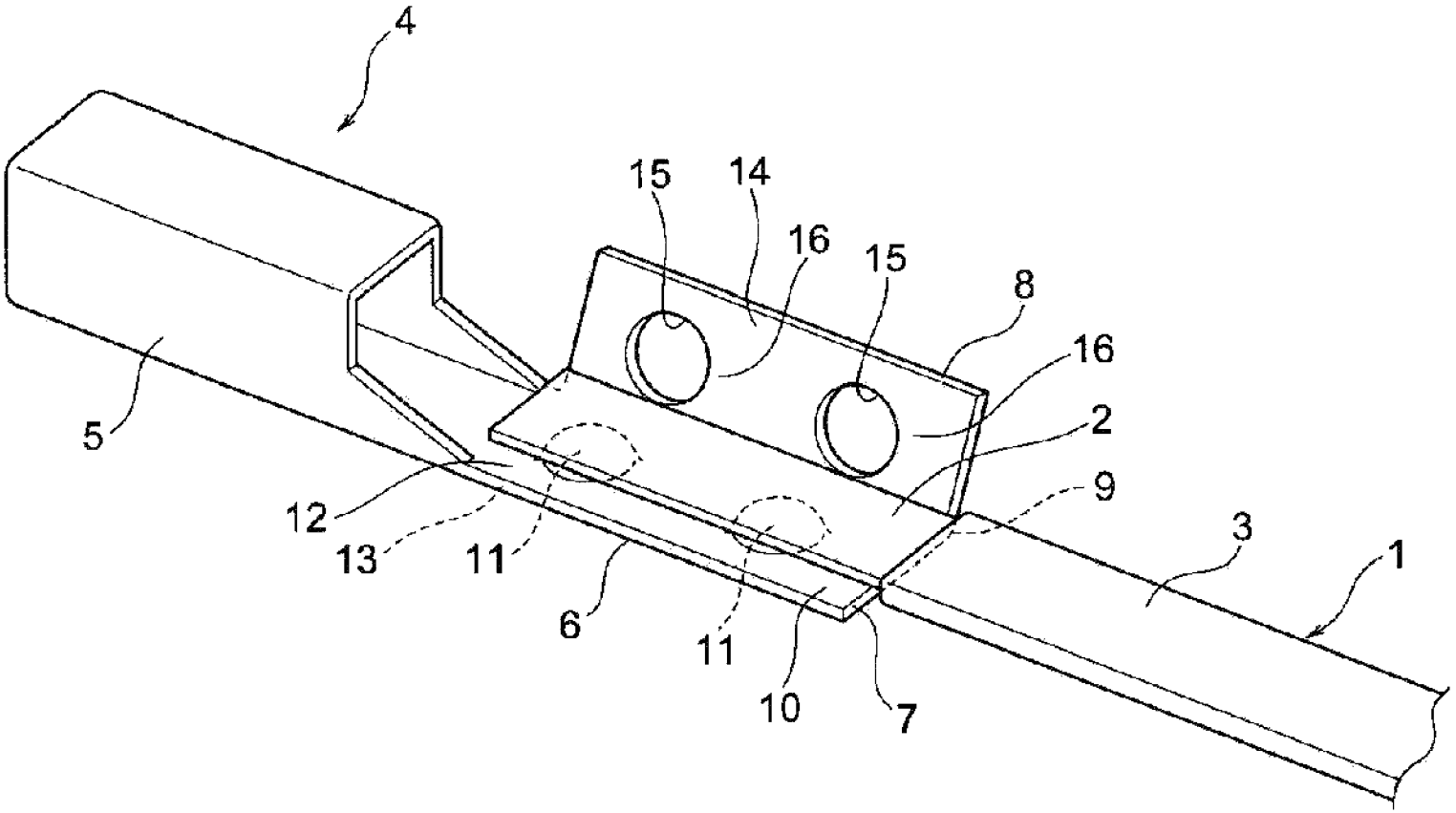
FIG. 2 is a perspective view which shows a state just before a conductor is connected to the conductor connecting part.
Figure 3:
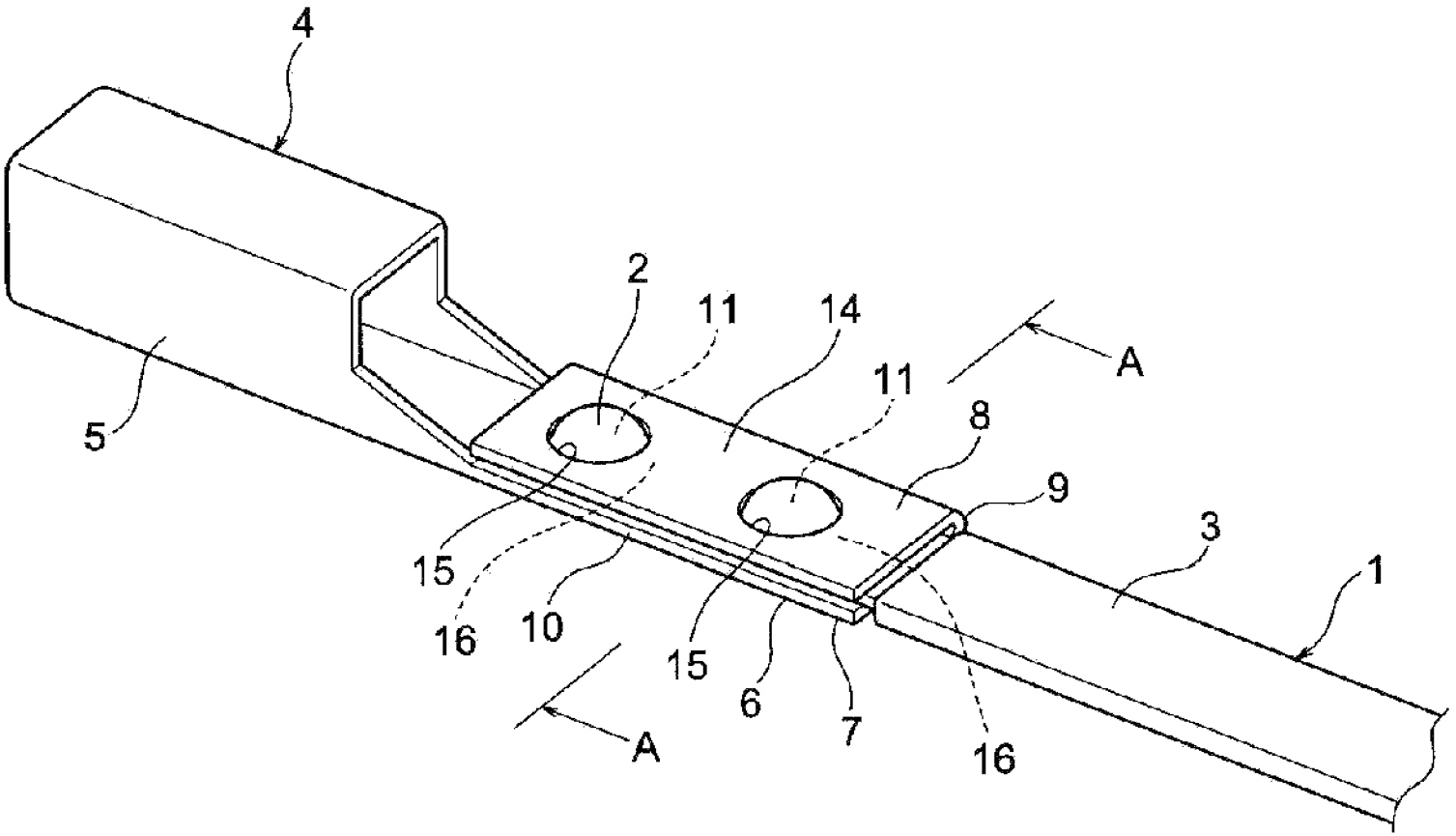
FIG. 3 is a perspective view which shows that the conductor is connected to the conductor connecting part.
Figure 4:
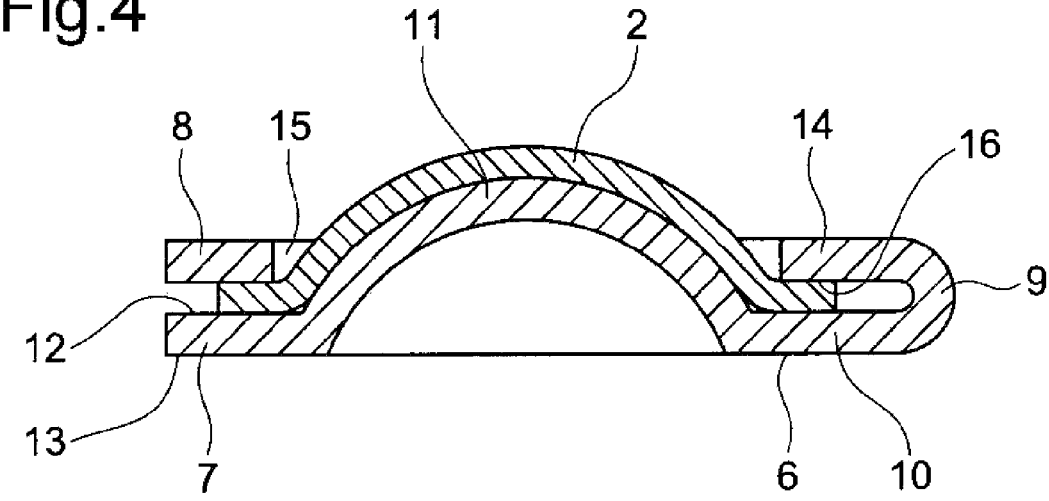
FIG. 4 is an A-A line sectional view of FIG. 3.

Next, an embodiment 1 is described with reference to the figures. FIG. 1 is a perspective view of a flat circuit body and a terminal metal fitting of a conductor connecting structure of the present invention. FIG. 2 is a perspective view which shows a state just before a conductor is connected to the conductor connecting part. FIG. 3 is a perspective view which shows that the conductor is connected to the conductor connecting part. FIG. 4 is an A-A line sectional view of FIG. 3.

In the following description, specific shapes, materials, numerical values, directions and the like are illustrated to facilitate the understanding of the present invention and may be changed appropriately in accordance with applications, objects and specifications.

In FIG. 1, a reference number 1 shows a flat circuit body. The flat circuit body 1 is an FPC (Flexible Printed Circuit) or an FFC (Flexible Fiat Cable), and is used for the wiring of a mobile body such as an automobile in the present embodiment. The reason for which the flat circuit body 1 is used in the mobile body, although not particularly limited, is that it is possible to reduce the thickness and weight of a wire harness.

When ordinary electric wires are used, there is a concern that the occupation space or the weight of a wire harness is increased, but if the flat circuit body 1 is used, there is no such a concern.

The flat circuit body 1 includes a conductor 2 and an insulator 3 which covers the conductor 2. The flat circuit body 1 is formed into a flat belt shape. In the flat circuit body 1 in the figures, only one conductor 2 is shown, but the flat circuit body 1 is not limited to this. That is, there may be a plurality of conductors 2. In this case, the plurality of conductors 2 are paralleled and spaced at a predetermined interval, and insulators 3 are provided to cover the plurality of conductors 2.

The conductor 2 is formed into a belt shape which extends straightly with a predetermined width. The conductor 2 is made of metal materials having conductivity such as copper or copper alloy. The conductor 2 has such a thickness that there is no damage such as break when an external force is applied to the conductor 2 itself. Further, the conductor 2 has such a thickness that deformation such as bending is possible when an external force is applied.

The insulator 3 is made of resin material having insulating property. The insulator 3 is formed into a film shape depending on the FPC or the FFC, and is formed by extrusion molding to have a predetermined thickness.

A predetermined length of the insulator 3 at a terminal part of the flat circuit body 1 is removed (the insulator 3 is removed in a predetermined range). Thereby, the conductor 2 is exposed (in an exposed state) from the insulator 3 and can be electrically connected with a terminal metal fitting 4 at the exposed part.

The terminal metal fitting 4 has an electrical contact part 5 which is formed as a part that electrically contacts with a mating terminal metal fitting not shown in the figures, and a conductor connecting part 6 which is formed as a part that is electrically connected with the conductor 2 of the flat circuit body 1. The terminal metal fitting 4 is formed, for example, into a shape shown in the figures by, for example, bending a metal plate having conductivity which has been punched into a predetermined expanded shape.

The shape of the electrical contact part 5 of the terminal metal fitting 4 is a female one in the embodiment, but is not limited to this. That is, the shape of the electrical contact part 5 may be a male one.

The electrical contact part 5 is formed into a female shape as mentioned above. In particular, the electrical contact part 5 is formed into a cylindrical shape of a rectangular cross section. An elastic contact strip which is not shown in the figures and has a cantilever shape is formed inside the electrical contact part 5. The elastic contact strip is formed as a part which has elasticity and electrically contacts with an electrical contact part of the mating terminal metal fitting not shown in the figures. The electrical contact part 5 is formed with a length corresponding to the electrical contact part of the mating terminal metal fitting.

The conductor connecting part 6 is formed integrally with the electrical contact part 5. The conductor connecting part 6 is so formed that the conductor 2 of the flat circuit body 1 can be electrically connected by being sandwiched. In particular, the conductor connecting part 6 has a first conductor holding part 7, a second conductor holding part 8 and a coupling bending part 9, and is so formed that the conductor 2 can be electrically connected by being sandwiched by the first conductor holding part 7 and the second conductor holding part 8.

As can be seen from the following description, the conductor connecting part 6 will not cause damage to the conductor 2 even if the conductor 2 is sandwiched by the first conductor holding part 7 and the second conductor holding part 8.

The first conductor holding part 7 has a first plate-like part 10 and projections 11 formed on the first plate-like part 10. Because the terminal metal fitting 4 is made of a metal plate, the first plate-like part 10 is formed into a plate-like shape as described above. The first plate-like part 10 is formed into a belt shape as a part corresponding to the bottom plate of the terminal metal fitting 4 in the conductor connecting part 6. The first plate-like part 10 is formed integrally with a part corresponding to the bottom plate of the terminal metal fitting 4 in the electrical contact part 5.

The first plate-like part 10 is formed to extend along the axial direction of the terminal metal fitting 4. A reference number 12 in the first plate-like part 10 shows a conductor facing surface which faces the conductor 2 of the flat circuit body 1. A reference number 13 shows a terminal bottom surface opposite to the conductor facing surface 12.

Two (this number is just an example) projections 11 are formed on the first plate-like part 10. These two projections 11 are arranged to be spaced a predetermined interval along the longitudinal direction (axial direction of the terminal metal fitting 4) of the conductor connecting part 6.

In the embodiment, the central axis of the two projections 11 is arranged to correspond to the central axis of the first plate-like part 10. The two projections 11 are, although not particularly limited, formed to have the same shape and size. One projection 11 is described as follows.

The projection 11 is formed as a projection part which projects from the conductor facing surface 12. In the embodiment, the projection 11 is formed into an embossed shape by making the terminal bottom surface 13 concave and making the conductor facing surface 12 convex. In particular, the projection 11 is formed into a dome-like indented shape.

The projection 11 is not limited to the above dome-like shape, but may have, for example, a hemispherical shape. Further, the projection 11 may have shapes of embodiments 2 or 3 to be described below. The projection 11 is formed to have a smooth curved surface (It is not necessary that the whole surface of the projection 11 is a curved surface. A variation of the projection 11 may be so formed that the projecting distal end has some flat surfaces to form a small mounting part where the conductor 2 of the flat circuit body 1 is mounted.).

The second conductor holding part 8 has a second plate-like part 14 and through holes 15 formed on the second plate-like part 14. Because the terminal metal fitting 4 is made of a metal plate, the second plate-like part 14 is formed into a plate-like shape as described above. The second plate-like part 14 is formed into a belt shape as a part which is laid over the first plate-like part 10 while the conductor 2 of the flat circuit body 1 is interposed between the first plate-like part 10 and the second plate-like part 14. The second plate-like part 14 is formed to extend along the axial direction of the terminal metal fitting 4. The second plate-like part 14 is coupled to the first plate-like part 10 through the coupling bending part 9.

The second plate-like part 14 is formed with two (this number is just an example) through holes 15. These two through holes 15 are arranged to be spaced a predetermined interval along the longitudinal direction (axial direction of the terminal metal fitting 4) of the conductor connecting part 6. In particular, the two through holes 15 are arranged so as to correspond to the positions of the projections 11. The through holes 15 are formed to penetrate with a size slightly larger than that of the projections 11 in consideration of the thickness of the conductor 2 of the flat circuit body 1 and in consideration of deformation of the conductor 2 to be described below.

Reference numbers 16 near the peripheries of the through holes 15, show pressing surfaces which press the conductor 2 of the flat circuit body 1. The pressing surfaces 16 not only press the conductor 2, but also electrically contact with the conductor 2.

The coupling bending part 9 is formed as a part which couples one side parts along the longitudinal direction of the first plate-like part 10 and the second plate-like part 14. The coupling bending part 9 is also formed as a part which is bent to make the second plate-like part 14 lay over the first plate-like part 10. When the second plate-like part 14 is bent, the coupling bending part 9 is bent to have a U-like section.

The coupling bending part 9 is formed into a shape in consideration of the thickness of the conductor 2 of the flat circuit body 1. The coupling to bending part 9 is formed in a shape in consideration of spring-back after the bending and the like.

In the above construction and structure, when the conductor 2, which is exposed, of the flat circuit body 1 as shown in FIG. 2 is placed on the first conductor holding part 7 (two projections 11) of the terminal metal fitting 4, and then the conductor 12 is sandwiched between the first conductor holding part 7 and the second conductor holding part 8 by bending the second plate-like part 14, the conductor 2 is electrically connected to the conductor connecting part 6 as shown in FIGS. 3 and 4.

The conductor 2 is deformed by the two projections 11 to be pushed into the corresponding through holes 15, and is pressed by the pressing surfaces 16 which are formed respectively at the peripheries of the two through holes 15.

The conductor 2 is sandwiched by the first conductor holding part 7 and the second conductor holding part 8 and is deformed and pressed with the sandwiching so that the conductor 2 will not fall out even if an external force is applied temporarily.

Because the above conductor connecting structure is such a structure that the conductor 2, which is exposed, of the flat circuit body 1 is sandwiched between the first conductor holding part 7 and the second conductor holding part 8 of the terminal metal fitting 4, an effect is achieved that when the conductor 2 is electrically connected, damage to the conductor 2 is not caused, and as a result, connection strength can be secured.

Because the above conductor connecting structure is such a structure that the conductor 2 is electrically connected by being sandwiched, an effect is achieved that drop of the contact pressure force and increase of the contact resistance is not caused as conventionally, and as a result, for example, dimension management related to the connection can be facilitated.

According to the above conductor connecting structure, because the part that is electrically connected can be easily recognized while the conductor 2 is exposed, an effect is achieved that it is unlikely that a conductor position deviation occurs.

Because the above conductor connecting structure is such a structure that the conductor 2 is electrically connected by being sandwiched, an effect is achieved that the contact area can be increased remarkably compared with before, and as a result, it is unlikely that increase of the contact resistance is caused.

Therefore, according to the above conductor connecting structure, an effect is achieved that connection reliability can be improved compared with before.

Embodiment 2

Figure 5:
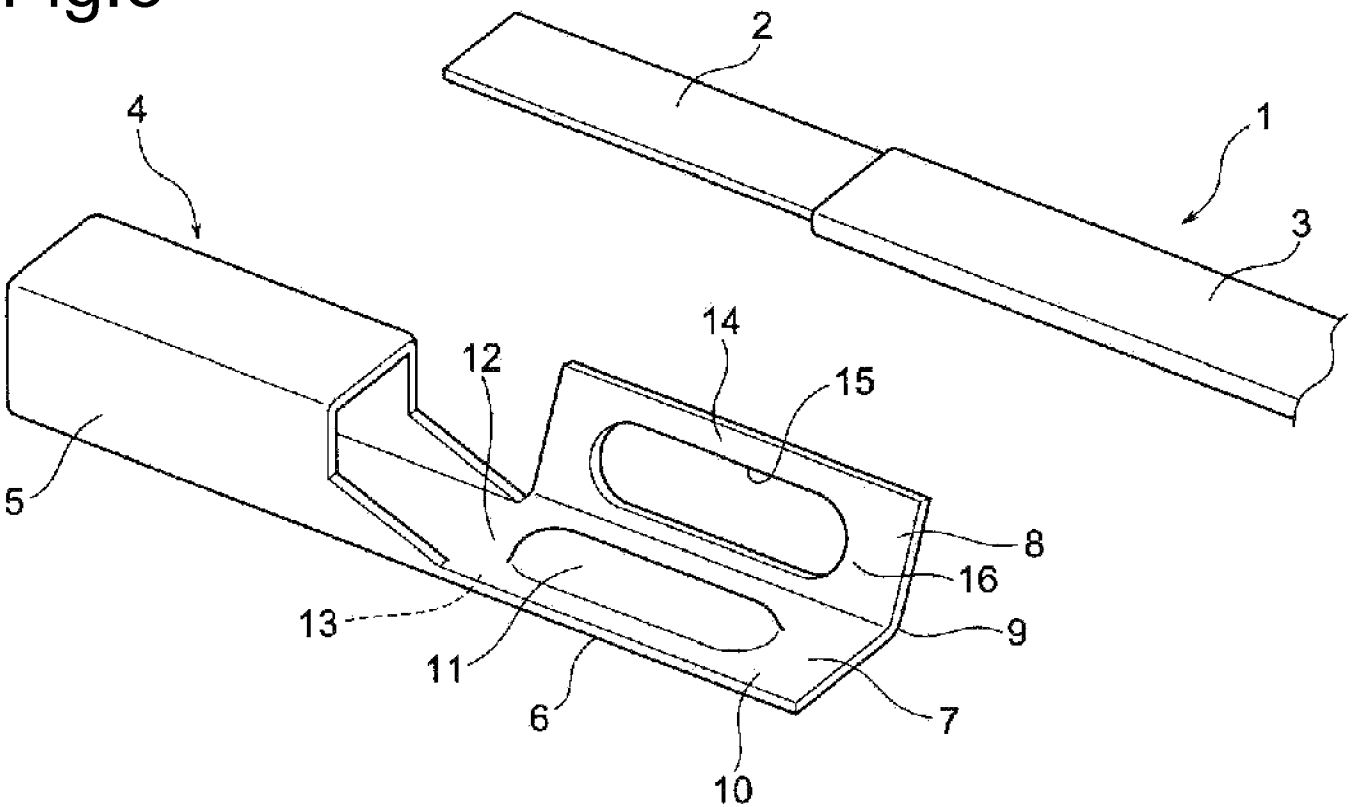
FIG. 5 is a perspective view of a flat circuit body and a terminal metal fitting of a conductor connecting structure of the present invention (embodiment 2).
Figure 6:
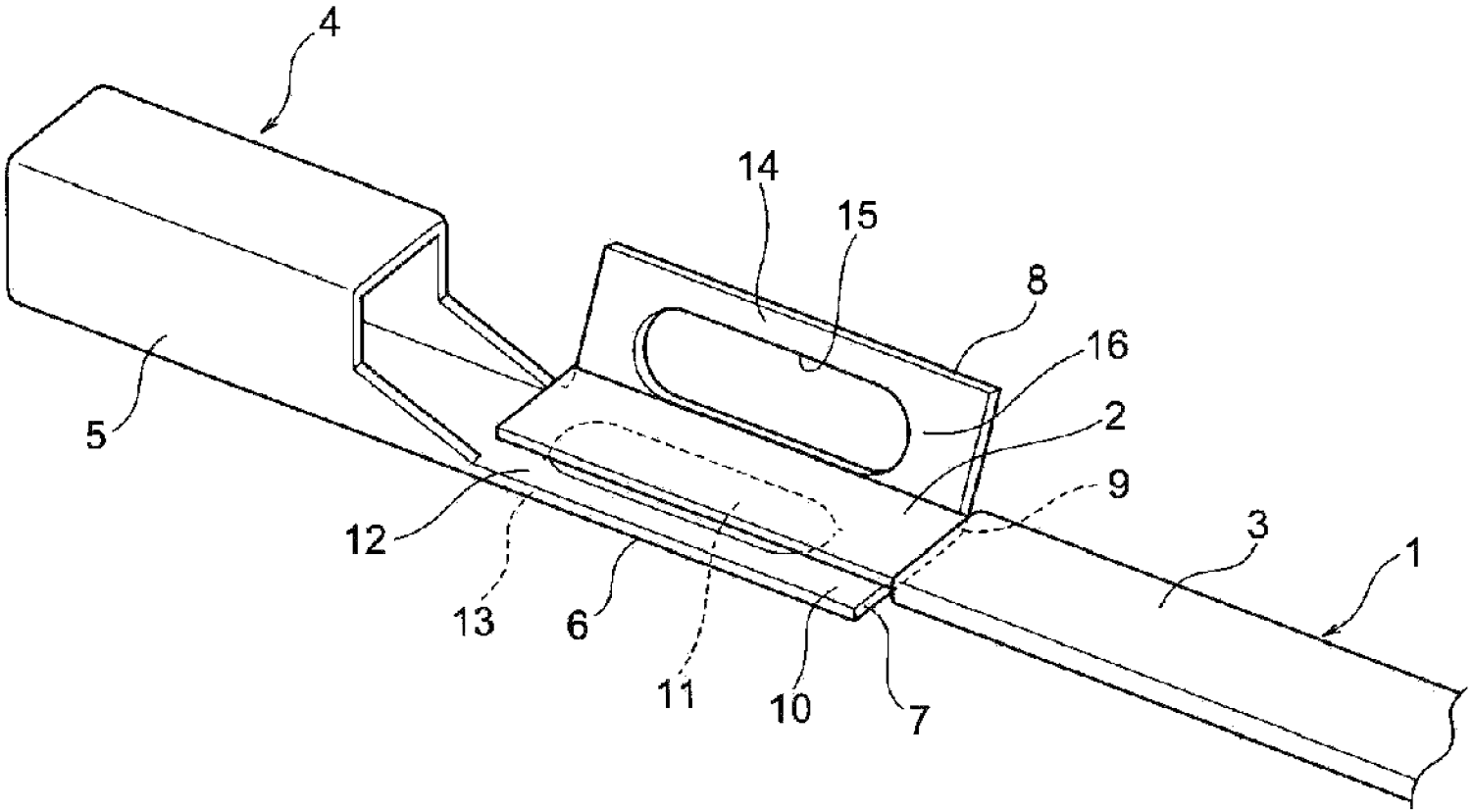
FIG. 6 is a perspective view which shows a state just before a conductor is connected to the conductor connecting part.
Figure 7:
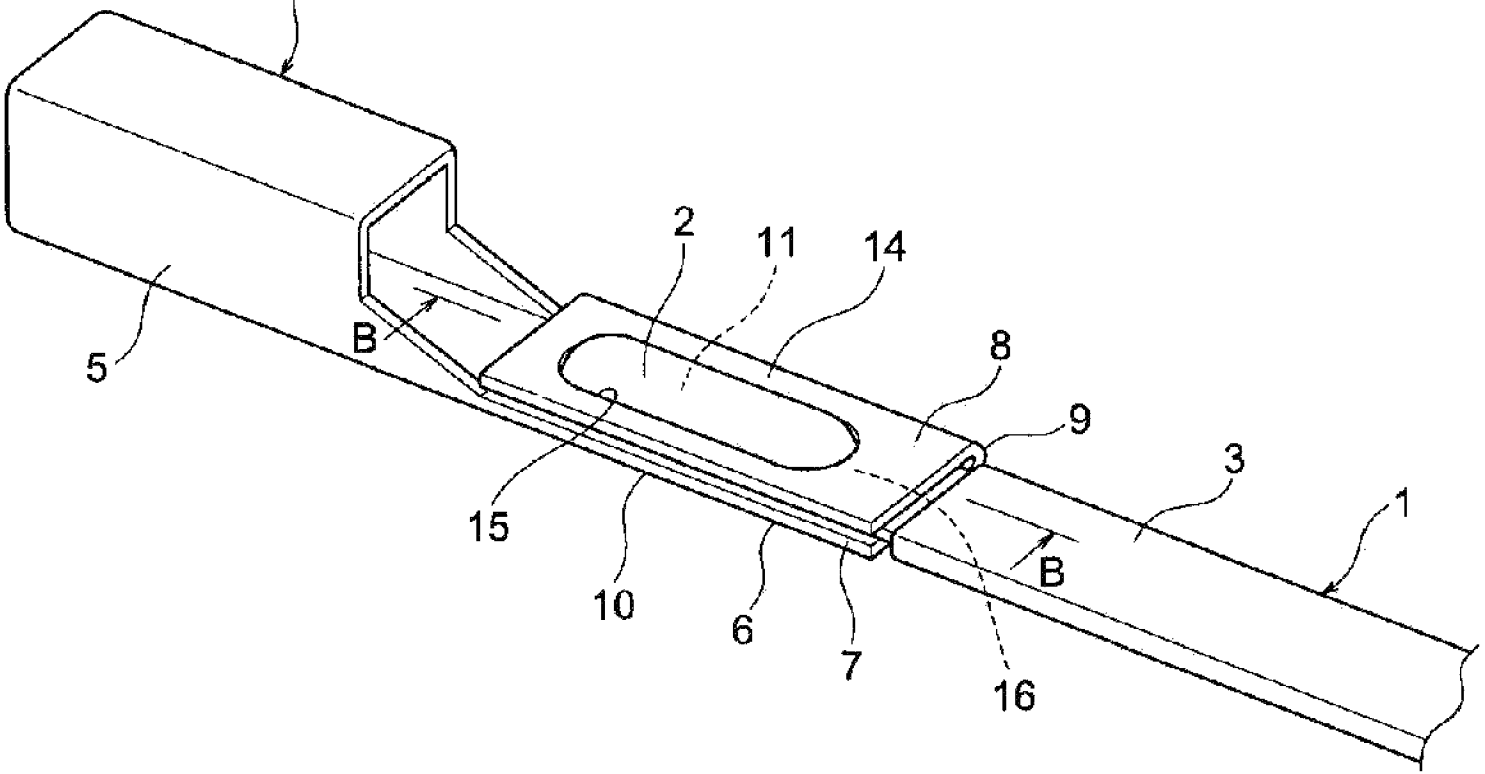
FIG. 7 is a perspective view which shows that the conductor is connected to the conductor connecting part.
Figure 8:
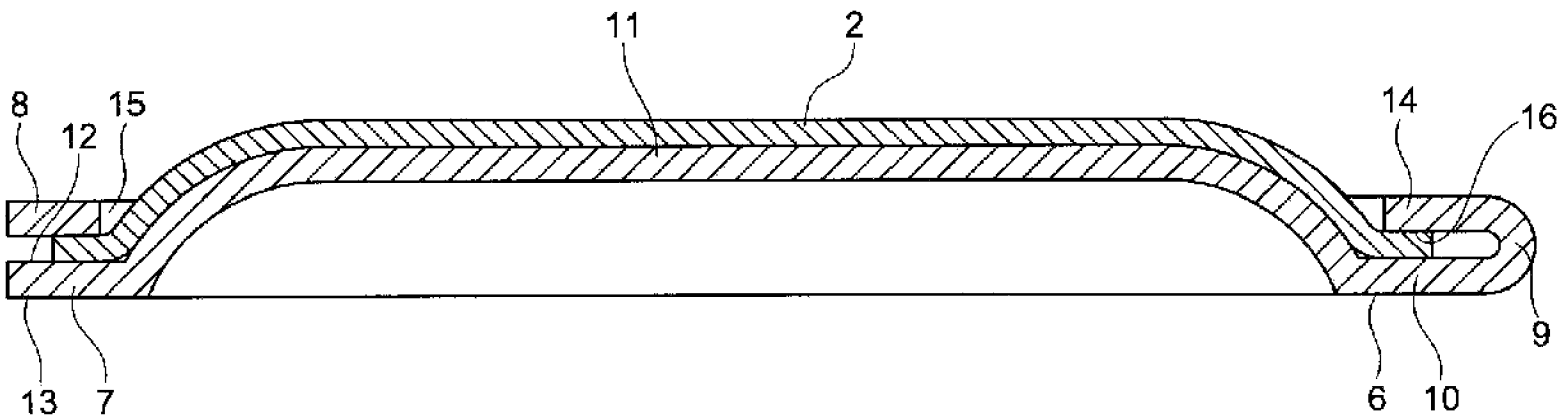
FIG. 8 is a B-B line sectional view of FIG. 7.

Next, an embodiment 2 is described with reference to the figures. FIG. 5 is a perspective view of a flat circuit body and a terminal metal fitting of a conductor connecting structure of the present invention. FIG. 6 is a perspective view which shows a state just before a conductor is connected to the conductor connecting part. FIG. 7 is a perspective view which shows that the conductor is connected to the conductor connecting part. FIG. 8 is a B-B line sectional view of FIG. 7. Components that are generally identical with those in the above-mentioned embodiment 1 are given identical numbers, and their detailed description is omitted.

In FIG. 5, a flat circuit body 1 includes a conductor 2 and an insulator 3. A terminal part of the flat circuit body 1 is processed to remove a predetermined length of the insulator 3 to expose the conductor 2.

A terminal metal fitting 4 has an electrical contact part 5 and a conductor connecting part 6. The terminal metal fitting 4 is formed, for example, into a shape shown in the figures by, for example, bending a metal plate having conductivity which has been punched into a predetermined expanded shape.

The electrical contact part 5 is formed into a cylindrical shape of a rectangular cross section. The conductor connecting part 6 is formed integrally with the electrical contact part 5. The conductor connecting part 6 has a first conductor holding part 7, a second conductor holding part 8 and a coupling bending part 9, and is so formed that the conductor 2 can be electrically connected by being sandwiched by these parts.

The first conductor holding part 7 has a first plate-like part 10 and a projection 11 formed on the first plate-like part 10. One projection 11 is formed on the first plate-like part 10. The projection 11 is formed into a projecting part which extends along the longitudinal direction (axial direction of the terminal metal fitting 4) of the conductor connecting part 6 and which has an elliptical shape when viewed from top.

In the embodiment, the central axis of the projection 11 in the longitudinal direction is arranged to correspond to the central axis of the first plate-like part 10. The projection 11 can be seen as a projecting part which extends to join the two projections 11 (refer to FIG. 1) of the embodiment 1 together. The projection 11 has an indented shape like the embodiment 1.

The second conductor holding part 8 has a second plate-like part 14 and a through hole 15 that is formed on the second plate-like part 14. The second plate-like part 14 is coupled to the first plate-like part 10 through the coupling bending part 9.

The second plate-like part 14 is formed with one through hole 15. The through hole 15 is arranged so as to correspond to the position of the projection 11. The through hole 15 is formed to penetrate with a size slightly larger than that of the projection 11 in consideration of the thickness of the conductor 2 of the flat circuit body 1 and in consideration of deformation of the conductor 2 to be described below. The through hole 15 of the present embodiment is formed into an elliptical shape. A pressing surface 16 is formed at the periphery of the through hole 15.

The coupling bending part 9 is formed as a part which couples one side parts along the longitudinal direction of the first plate-like part 10 and the second plate-like part 14. The coupling bending part 9 is also formed as a part which is bent to make the second plate-like part 14 lay over the first plate-like part 10.

In the above construction and structure, when the conductor 2, which is exposed, of the flat circuit body 1 as shown in FIG. 6 is placed on the first conductor holding part 7 (the projection 11) of the terminal metal fitting 4, and then the conductor 12 is sandwiched between the first conductor holding part 7 and the second conductor holding part 8 by bending the second plate-like part 14, the conductor 2 is electrically connected to the conductor connecting part 6 as shown in FIGS. 7 and 8.

The conductor 2 is deformed by the projection 11 to be pushed into the through hole 15, and is pressed by the pressing surface 16 which is formed at the periphery of the through hole 15.

The conductor 2 is sandwiched by the first conductor holding part 7 and the second conductor holding part 8 and is deformed and pressed with the sandwiching so that the conductor 2 will not fall out even if an external force is applied temporarily.

Of course, the conductor connecting structure of the embodiment 2 achieves the same effects as those of the embodiment 1. That is, an effect is achieved that connection reliability can be improved compared with before.

Embodiment 3

Figure 9:
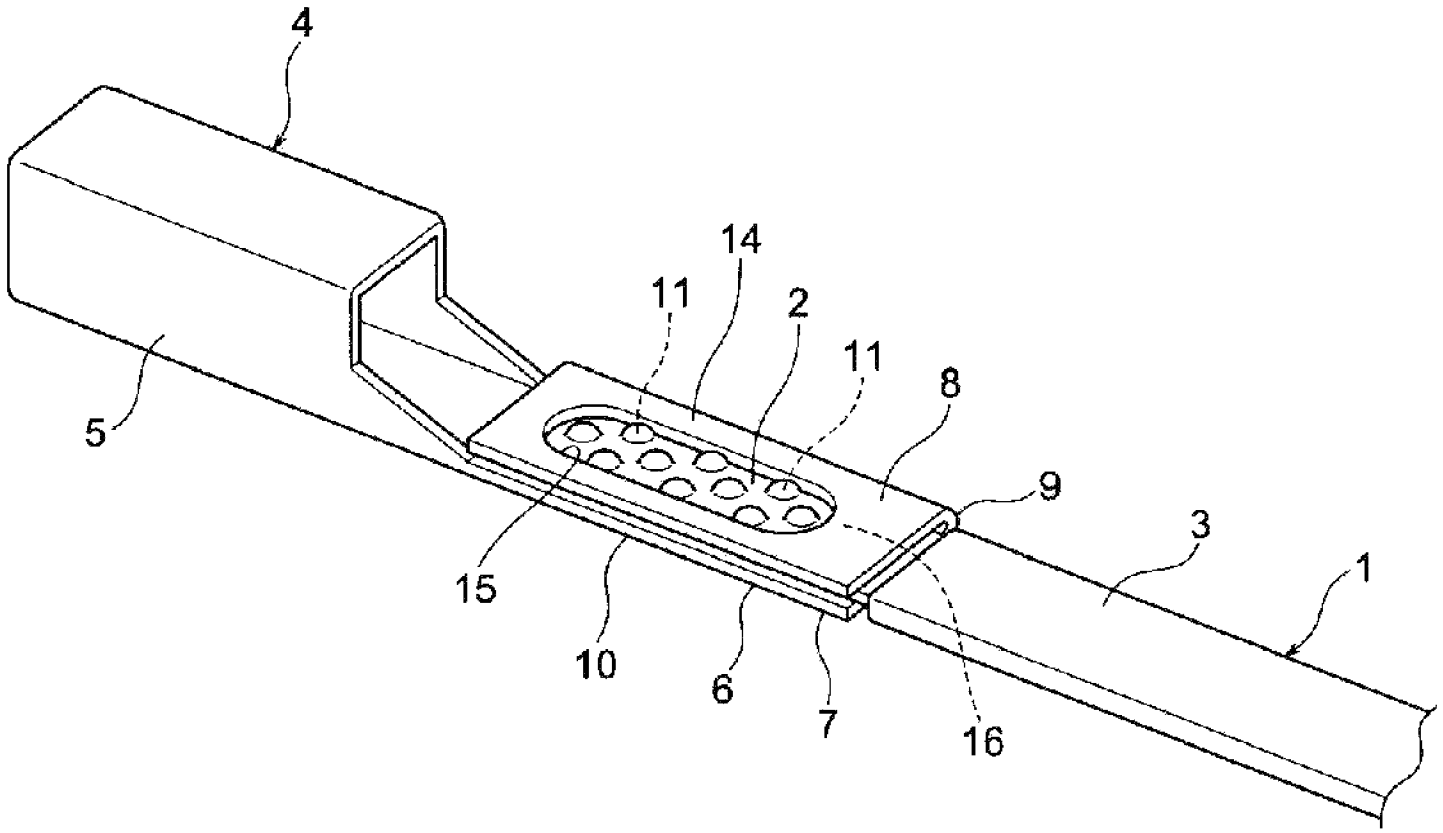
FIG. 9 is a perspective view of a flat circuit body and a terminal metal fitting of a conductor connecting structure of the present invention (embodiment 3).

Next, an embodiment 3 is described with reference to the figures. FIG. 9 is a perspective view of a flat circuit body and a terminal metal fitting of a conductor connecting structure of the present invention. Components that are generally identical with those in the above-mentioned embodiment 1 are given identical numbers, and their detailed description is omitted.

In FIG. 9, a terminal metal fitting 4 has a first conduct holding part 7 which is provided with a plurality of projecting parts 11 whose projection height is lower and whose size is smaller than those of the projections 11 of the embodiment 1. The terminal metal fitting 4 has a second conductor holding part 8 which is provided with a through hole 15 formed into the same elliptical shape as that in the embodiment 2.

When the conductor 2 of the flat circuit body 1 is sandwiched between the first conductor holding part 7 and the second conductor holding part 8 of the terminal metal fitting 4, the conductor 2 is electrically connected to the conductor connecting part 6 as shown in the figure.

The conductor 2 is deformed by the plurality of projections 11 to be pushed into the through hole 15, and is pressed by the pressing surface 16 which is formed at the periphery of the through hole 15.

The conductor 2 is sandwiched by the first conductor holding part 7 and the second conductor holding part 8 and is deformed and pressed with the sandwiching so that the conductor 2 will not fall out even if an external force is applied temporarily.

Of course, the conductor connecting structure of the embodiment 3 achieves the same effects as those of the embodiment 1. That is, an effect is achieved that connection reliability can be improved compared with before.

Embodiment 4

Figure 10:
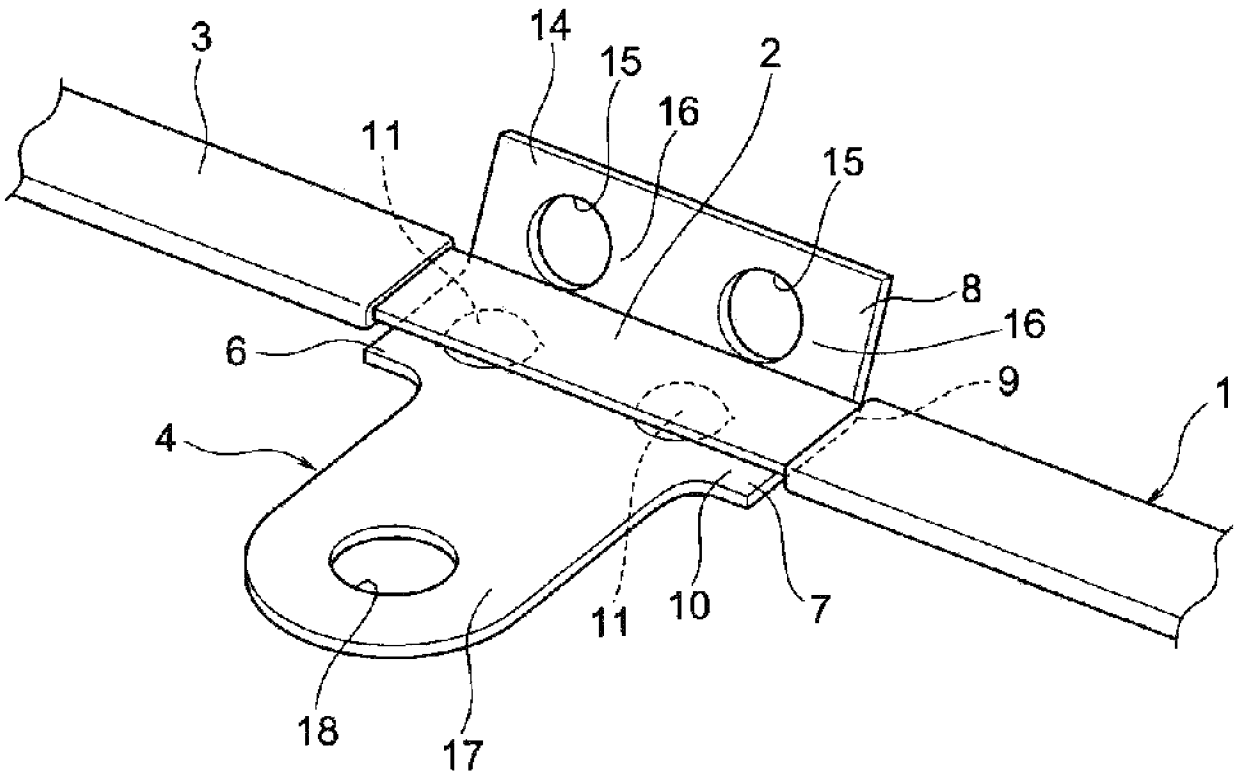
FIG. 10 is a perspective view of a flat circuit body and a terminal metal fitting of a conductor connecting structure of the present invention (embodiment 4).

Next, an embodiment 4 is described with reference to the figures. FIG. 10 is a perspective view of a flat circuit body and a terminal metal fitting of a conductor connecting structure of the present invention. Components that are generally identical with those in the above-mentioned embodiment 1 are given identical numbers, and their detailed description is omitted.

In FIG. 10, a flat circuit body 1 includes a conductor 2 and an insulator 3. The middle part of the flat circuit body 1 is processed to remove a predetermined length of the insulator 3 to expose the conductor 2.

A terminal metal fitting 4 has an electrical contact part 17 and a conductor connecting part 6. The terminal metal fitting 4 is formed, for example, into a shape shown in the figure by, for example, bending a metal plate having conductivity which has been punched into a predetermined expanded shape.

The conductor connecting part 6 has a first conductor holding part 7, a second conductor holding part 8 and a coupling bending part 9, and is so formed that the conductor 2 can be electrically connected by being sandwiched by these parts. The conductor connecting part 6 is formed into the same shape as that in the embodiment 1.

The electrical contact part 17 is formed into a tongue shape. A bolt though hole 18 is formed to penetrate the electrical contact part 17 of such a shape. The base end of the electrical contact part 17 is formed integrally with a side part of a first plate-like part 10 in the first conductor holding part 7.

In the above construction and structure, when the conductor 2, which is exposed, of the flat circuit body 1 as shown in the figure is placed on the first conductor holding part 7 (two projections 11) of the terminal metal fitting 4, and then the conductor 12 is sandwiched between the first conductor holding part 7 and the second conductor holding part 8 by bending the second plate-like part 14, the conductor 2 is electrically connected to the conductor connecting part 6 (refer to FIGS. 3 and 4 for the connected state of the conductor 2 and the conductor connecting part 6).

The conductor 2 is deformed by the two projections 11 to be pushed into the corresponding through holes 15, and is pressed by the pressing surfaces 16 which are formed respectively at the peripheries of the two through holes 15.

Of course, the conductor connecting structure of the embodiment 4 achieves the same effects as those of the embodiment 1. That is, an effect is achieved that connection reliability can be improved compared with before.

The conductor connecting structure of the embodiment 4 is effective when the middle part of the flat circuit body 1 is to be electrically connected.

In addition, it is apparent that various modifications can be made to the invention without changing the purpose of the invention.

This application is based upon and claims the benefit of priority of Japanese Patent Application 2012-186058 filed on Aug. 27, 2012, the contents of which are incorporated herein by reference.

What is claimed is:

1. A conductor connecting structure, comprising:

a flat circuit body having an insulator and a conductor that is exposed from the insulator; and a conductive terminal metal fitting having a conductor connecting part to be electrically connected with the conductor;

wherein the conductor connecting part comprises a first conductor holding part and a second conductor holding part;

the first conductor holding part has a first plate-like part which is formed into a plate-like shape, and a projecting part which projects from a surface of the first plate-like part that is faced to the conductor;

the second conductor holding part has a second plate-like part which is formed into a plate-like shape, and a through hole which is arranged so as to correspond to a position of the projecting part and which penetrates the second plate-like part; and when the conductor is sandwiched by the first conductor holding part and the second conductor holding part, the conductor is deformed by the projecting part so as to be pushed into the through hole and is pressed at a periphery of the through hole.

2. The conductor connecting structure according to claim 1, wherein one side parts of the first conductor holding part and the second conductor holding part along a longitudinal direction of the conductor connecting part are formed as a coupling bending part.

3. The conductor connecting structure according to claim 1, wherein a plurality of the projecting parts and a plurality of the through holes are formed along the longitudinal direction of the conductor connecting part.

4. The conductor connecting structure according to claim 1, wherein the projecting part and the through hole are formed so as to be extended along the longitudinal direction of the conductor connecting part.

* * * * *